United States Patent [19]

Sommer et al.

[11] Patent Number: 4,824,350

[45] Date of Patent: Apr. 25, 1989

[54] SLIDING SHUTTERING SYSTEM

[75] Inventors: Arnold Sommer, Kaarst, Fed. Rep. of Germany; Richard Lienbacher, Golling; Guido Herzog, Salzburg, both of Austria

[73] Assignee: Gleitbau-Gesellschaft m.b.H., Salzburg, Austria

[21] Appl. No.: 941,081

[22] Filed: Dec. 12, 1986

[51] Int. Cl.[4] ..... E04G 11/22

[52] U.S. Cl. ..... 425/63; 249/20; 249/152; 249/155; 249/178; 249/184; 264/32; 425/65

[58] Field of Search ..... 249/13, 17, 20–22, 249/48, 49, 144, 152, 153, 155, 157, 178, 180, 179, 219 R; 425/63–65; 264/32–34

[56] References Cited

U.S. PATENT DOCUMENTS

| | | | |
|---|---|---|---|
| 3,632,079 | 1/1972 | Rohlf | 249/17 |
| 3,659,978 | 5/1972 | Svensson et al. | 249/20 |
| 4,063,857 | 12/1977 | Thoma | 249/20 |
| 4,374,634 | 2/1983 | Ahl | 425/65 |

FOREIGN PATENT DOCUMENTS

| | | | |
|---|---|---|---|
| 2304864 | 8/1973 | Fed. Rep. of Germany | 249/20 |

*Primary Examiner*—Jay H. Woo
*Assistant Examiner*—James C. Housel
*Attorney, Agent, or Firm*—Fleit, Jacobson, Cohn & Price

[57] ABSTRACT

The invention relates to a sliding shuttering system for producing concrete structure walls, particularly for conical and/or sloping reinforced concrete structures with annularly closed, varying cross-sections. Especially in the case of sloping structures with upwardly diverging wall regions, the hitherto known sliding shuttering systems can only be used to a limited extent with regards stability and security. In order to be able to perform a sliding process even in the case of extreme structure configurations, the support is made rigid and is mounted on angularly adjustable piles, at least one of the pairwise associated piles being fixed to the support to prevent horizontal shifting.

8 Claims, 5 Drawing Sheets

FIG. 1
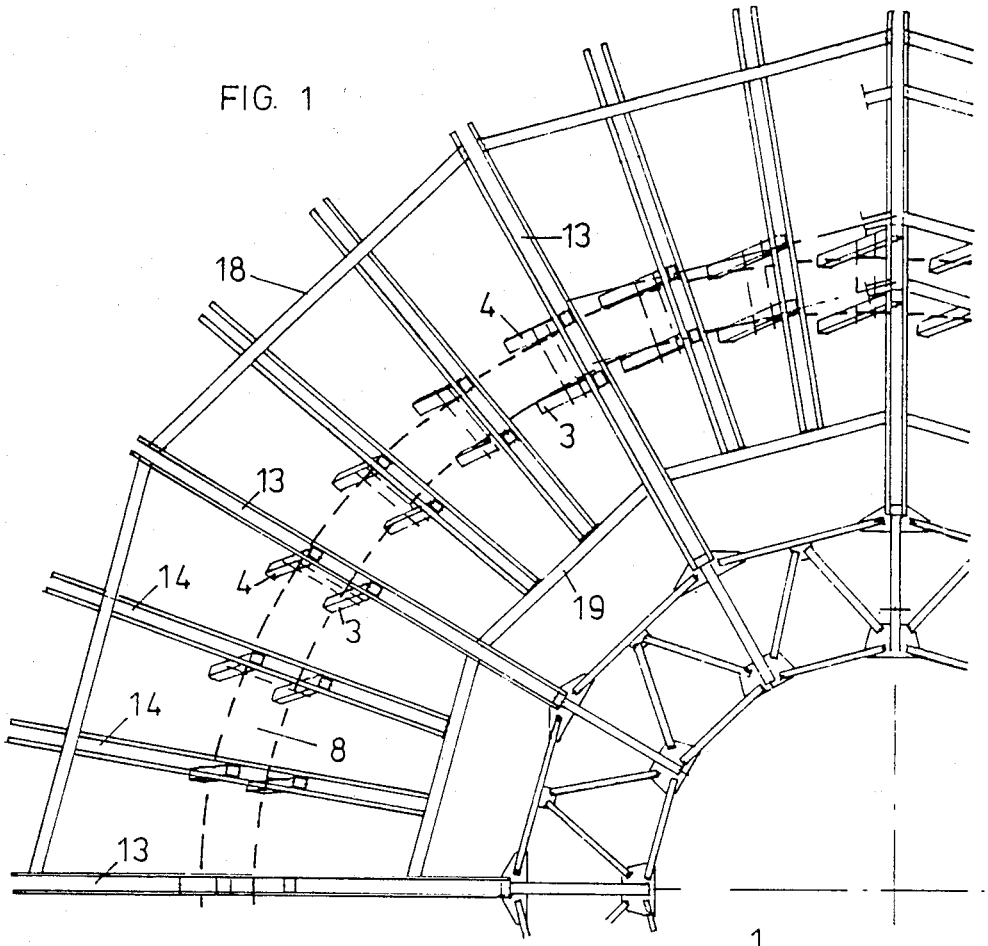
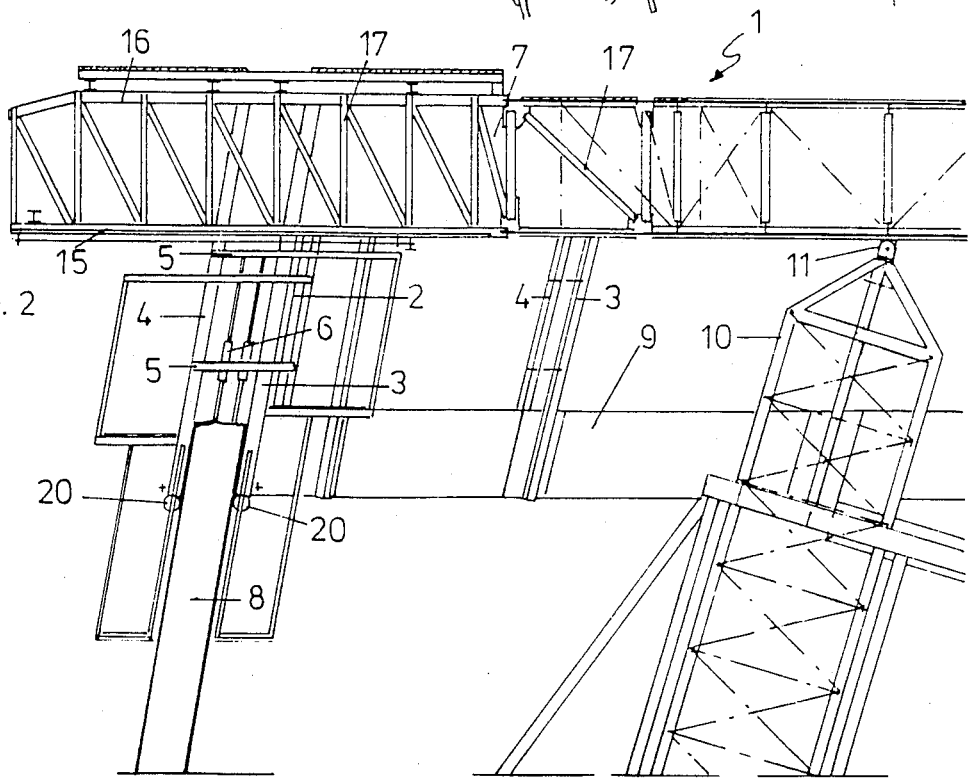
FIG. 2

SLIDING SHUTTERING SYSTEM

The invention relates to a sliding shuttering or formwork system for producing building or structure walls made from concrete.

Such a sliding shuttering system is known from DE-OS 29 47 210. This known sliding shuttering system is very complicated and designed in a redundant manner with respect to its pile structure and its non-positive articulation of the support structure. Due to the non-positive articulation between the pile structure and the support structure resting on it, the known sliding shuttering system is not suitable for the erection of annular concrete structure walls, in which the actual structure has an axis inclined with respect to the vertical axis and optionally upwardly diverging, facing structure walls. In the known system, wall thickness or strength changes are primarily realized by the relative adjustability of the actual sliding shuttering. In the known system, shoring against the fabricated structure wall to be strengthened has the disadvantage that horizontal forces of the complete sliding shuttering system can be introduced into the area of the still not hardened concrete wall, which may lead to cracking.

On the basis of this prior art, the problem addressed by the present invention is to construct a sliding shuttering system of the present type so that even in the case of annular, sloping structures, even with upwardly, zonally diverging facing wall areas, it makes possible in a simple manner maximum stability, reliability and precision in the completely satisfactory erection of even complicated structures.

According to the invention this problem is solved.

The inventively essential basic principles of the sliding shuttering system are considered by means of a sloping, annular concrete structure, in which in an axial vertical section both facing structure walls are to be erected sloping to one side and in which the walls also diverge in certain height regions and then converge towards one another again. In other words, a "sloping" structure is to be produced with a diameter increase in one height region.

To solve this statically difficult problem, the top support means is constructed rigidly both horizontally and vertically and preferably from the weight standpoint a girder grillage with radially directed girder pairs is provided. In order to be able to support said girder grillage in a precisely horizontal manner on the pile structure and provide substantially uniform introduction of forces into the piles, in the case of differently sloping structure walls it is necessary to have a lengthwise adjustable means at least for the piles located on the sloping side. In the case of complicated structures, appropriately both associated inner and outer piles are equipped with a lengthwise adjustable means positioned above the pile cross-members.

Since in particular in the case of asymmetrical structures there can be shifting of forces, at least one of the pairwise associated piles is fixed to the girder grillage so as to prevent horizontal shifting, but the relative position with respect to said grillage is adjustable. Appropriately such a horizontal locking is provided for all the piles.

For introducing forces into the lower areas of a structure with sloping diverging walls, it is possible to provide a sliding device acting in the centre of the girder grillage and guided in the interior of the structure and which is supported on two facing wall regions In the case of annular structures with diverging walls, the introduction of linearly rigid piles into the girder grillage resting thereon would lead to a complicated construction of the girder grillage, particularly of the individual girder pairs between which project the top regions of the piles, because in this case it would not only be necessary to absorb slopes with respect to the vertical axis, e.g. in the radial direction, but also slope with respect to the vertical axis in the circumferential direction. In order to solve this problem in a relatively simple manner, the piles are not linearly rigid over their length and are either bent in fixed manner or preferably adjustable as regards their angles of inclination. This bendability of the piles is appropriately located in the bearing regions of the girder grillage with the piles, so that the top ends of the piles can be guided between the girder pairs of the girder grillage, optionally accompanied by a radial circumferential inclination.

In order to circumferentially adjust the piles and particularly for a force distribution from the overhanging side of a structure to the roughly diametrically facing side, the sliding shuttering system is appropriately equipped with an inner and outer, adjustable locking ring connected at least to the main piles. In order to be able to bring about an introduction of forces into the region of the already set or hardened concrete wall, the piles are advantageously provided in their lower end region with a shoring means, which slides with the same. Despite the conventional arrangement of the outer and inner locking ring at the height level of the sliding shuttering, it is possible to transfer forces of an "overhang region" of the structure from the outer locking ring acting as a pull ring to the diametrically facing outside, where they are introduced by means of the sliding roller into the hard concrete wall. In this case the inner locking ring acts as a "thrust ring", by means of which the horizontal forces of the inner piles acting in this area are transferred to the inside of the "overlap region" and can be introduced into the structure wall through the sliding roller supported against the hard concrete wall.

In order to achieve an optimum force distribution to all piles, advantageously the pairwise associated piles are in each case equipped with lengthwise adjustable means. In order to permit easy operation of the lengthwise adjustable means, they are appropriately telescopically adjustable by means of an easily accessible spindle. In addition to simple mechanical telescopic connections, it is also possible to provide hydraulically or pneumatically controllable setting means for the length of the piles. It is essential to control the non-positive bearing of the girder grillage on the two pairwise associated piles. The lengthwise adjustable means can alternatively or in combination have an outer or inner pile guide. Combined with the inclinability of the pile, preference is given to a universal type articulation or joint with the mechanical principle of the lengthwise adjustable means and at the top said articulation or joint is operable on the pile. A simple constructional principle for the bendability of the pile provides for a separation of the pile in the bearing region for the girder grillage, with a one-sided articulation and expandability or spreadability on the opposite side, e.g. by means of a spindle. This device for bending the pile, e.g. in a range of 2 to 10° can be so compensated in the vicinity of the vertical extension of the girder grillage by an oppositely directed articulation and spreading that the top end of the pile can be guided within a girder pair of the girder grillage.

In order to achieve a more favourable dimensioning for the lengthwise adjustable means, it is mainly designed for tensile stress, so that the spindle drives e.g. provided for this can have smaller diameters than in the case of a compression stressing.

The horizontal locking of at least one pile of a pile pair is preferably provided in the vicinity of the lengthwise adjustable means, whereby e.g. a clamping device can be provided with respect to a lower cord of the girder grillage or a draw-in or feed rail for the horizontal adjustability of the piles.

For the horizontal or radial adjustability of the outer piles, a spindle device fixed to the underside of the girder grillage is appropriately provided. Appropriately a fixed spindle is used, the pile or piles being horizontally adjustable by means of threaded bushes displaceable on the spindle. The actuation of the threaded bushes fixed to the corresponding pile in the horizontal direction can e.g. take place by means of a hydraulic motor. Advantageously spindles are provided on either side of the piles for the horizontal adjustability of the latter.

The invention is described in greater detail hereinafter relative to the drawings.

FIG. 1 illustrates a sector detail of a girder grillage in plan view in the case of a sloping structure with the sloping position of the individual piles indicated.

FIG. 2 illustrates a partial view of the structure with sliding shuttering system in vertical section corresponding to the sector of FIG. 1.

Figure 3:
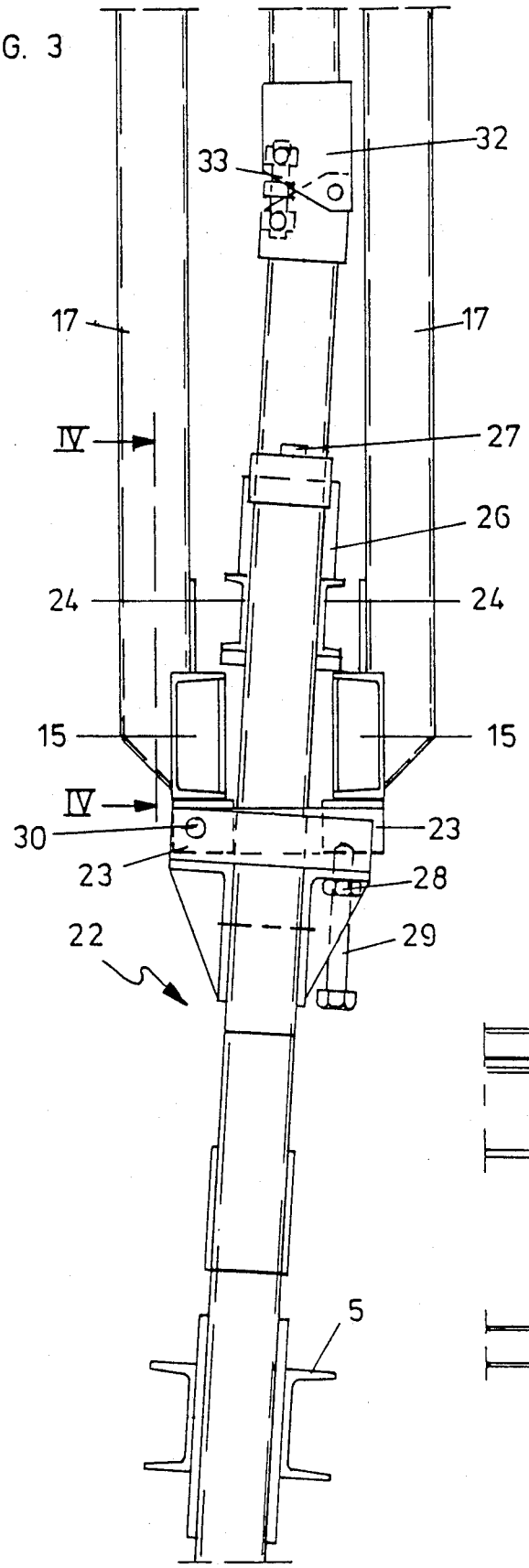
FIG. 3 illustrates a fragmental representation of a sloping pile in the bearing region of the girder grillage and which extends at right angles to the drawing plane.

FIGS. 1 and 2 show a sliding shuttering system 1, such as can in particular be used in an annular, sloping structure with diverging wall regions. The sliding shuttering system 1 includes a truss or girder grillage 7 symmetrical to central axis 11 or the centre point and which comprises radially oriented main girders 13 and circumferentially interposed intermediate girders 14. Girder grillage 7 is provided to carry construction equipment, such as craneways, in a manner well known in the art. In the vertical direction lower cord 15 and upper cord 16 of girder grillage 7 is provided with a latticework structure 17 which, together with the outer and inner tangential struts 18, 19 make the girder grillage intrinsically rigid. The lower cord 15 of girder grillage 7 rests on bearings of the inner and outer piles 3, 4, which are connected by means of cross-members 5 to form a parallelogram-like pile structure 2 so that the girder gillage 7 is coupled to and guided by the inner and outer piles 3 and 4. Piles 3, 4 preferably extend over the entire height of girder grillage 7 and are at least circumferentially guided between the U-shaped girder pairs of a girder means.

Piles 3, 4 extend downwards to such an extent that the sliding rollers 20 fitted in the lower region can slidingly support the piles 3 and 4 against the set or hard concrete wall 8 so that piles 3 and 4 are oriented parallel to the wall 8 as FIG. 2 clearly illustrates. In the case of structures with sloping and in particular diverging walls, it is possible to provide within the structure an also sliding support girder 10, which is articulated in the central axis 11 of girder grillage 7 and is supported in the upper not shown region on the inner face of the more sloping concrete wall and in the lower region on the inner face of the overhanging concrete wall.

In annularly surrounding manner an inner and outer sliding shuttering 9 is fixed to the insides of the outer and inner pile 3, 4. The complete sliding shuttering system 1 is guided so as to slide up relative to the ground along climbing bars by means of two lifting members 6, which are non-positively articulated to the lower cross-member.

Particularly in the case of sloping, overhanging structures, it is necessary for the purpose of guiding the piles to provide in the vicinity of the girder grillage 7 a bendability of slopability of the piles in the circumferential direction and optionally also in the radial direction. A simplified embodiment for this purpose is shown in FIG. 3. Sloping against the vertical axis, an inner pile 22 projects between the girder grillage structure 17, the slopability of pile 22 being adjustable in the bearing region of the spaced lower cords 15. For this purpose on the left-hand side pile 22 is articulated in hinged manner through a bearing roller 23 by means of a bearing bolt 30. On the facing right-hand side, a sloping spindle 29 engages by means of a T-piece and a nut 28 e.g. welded thereto engages into a recess of bearing roller 23. Through a corresponding clockwise rotation of the sloping spindle, it is possible to increase the opening angle between the bearing rollers 23 and the T-piece of the lower part of pile 22.

For compensating or further bending with respect to the bearing region of the girder grillage, a pile joint 32 is provided in the upper region of the pile and is roughly oppositely directed to the lower bending means. This upper pile joint 32 is provided in the right-hand region with a bolt articulation and in the left-hand region with a roughly vertically directed threaded bolt 33 with oppositely directed threads at the top and bottom. On turning threaded bolt 33 said pile joint will consequently assume a larger or smaller angle of inclination.

Figure 4:
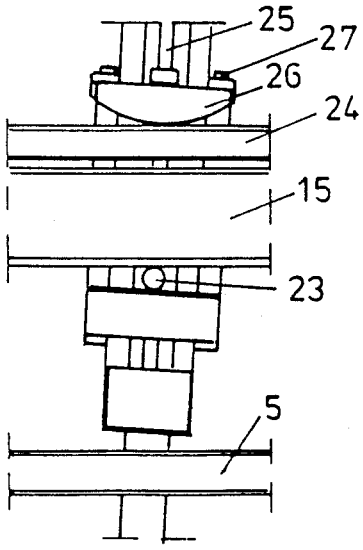
FIG. 4 shows a diagrammatic fragmental view along line IV—IV of FIG. 3

Above lower cord 15 the pile is provided with a lengthwise adjustable means used to connect inner and outer piles 3 and 4 to the girder grillage 7. The lengthwise adjustable means embraces the pile in the embodiment according to FIGS. 3 and 4. The forked pile led upwards above the upper pile cross-member 5 is externally surrounded by a sliding means, which guides the bearing roller 23 in a vertically adjustable manner. This sliding means is vertically adjustable by means of a top spindle 25 and a downwardly arcuate spindle bearing 26 can be arrested against a horizontally directed draw-in rail 24 by means of clamping spindles 27 on either side for the purpose of locking the pile in the horizontal direction. At a bend of pile 22, spindle 25 is appropriately led by a universal type joint which accomodates bending of the pile and hence of the spindle 25, to the top of the pile, from where it can be actuated. By means of a nut rigidly fixed to the spindle bearing 26, it is possible to vertically adjust the outer slide frame of the length adjusting means.

Figure 5:
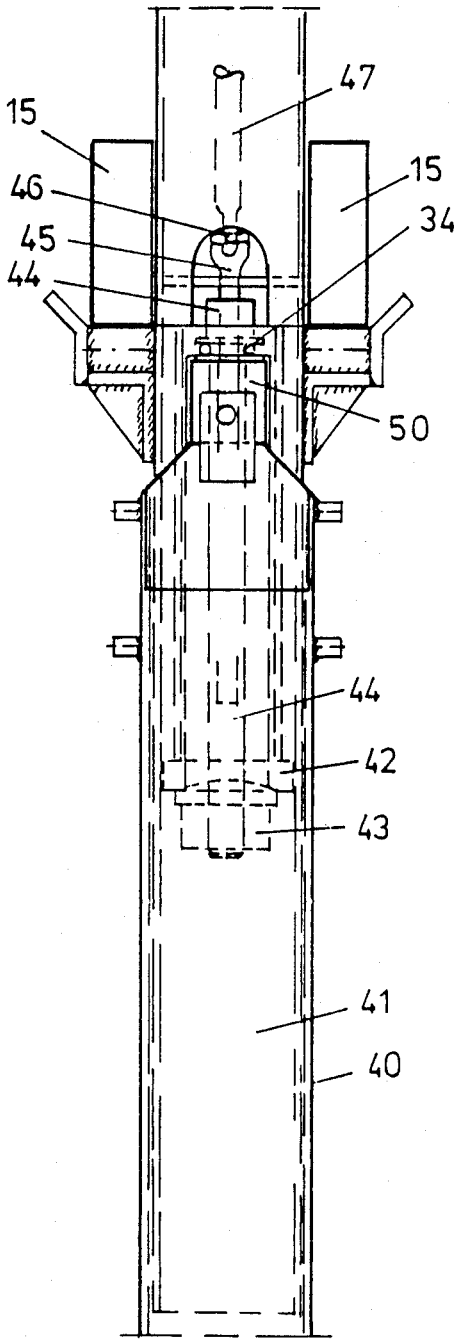
FIG. 5 illustrates a lengthwise adjustable means provided in the interior of the pile.
Figure 6:
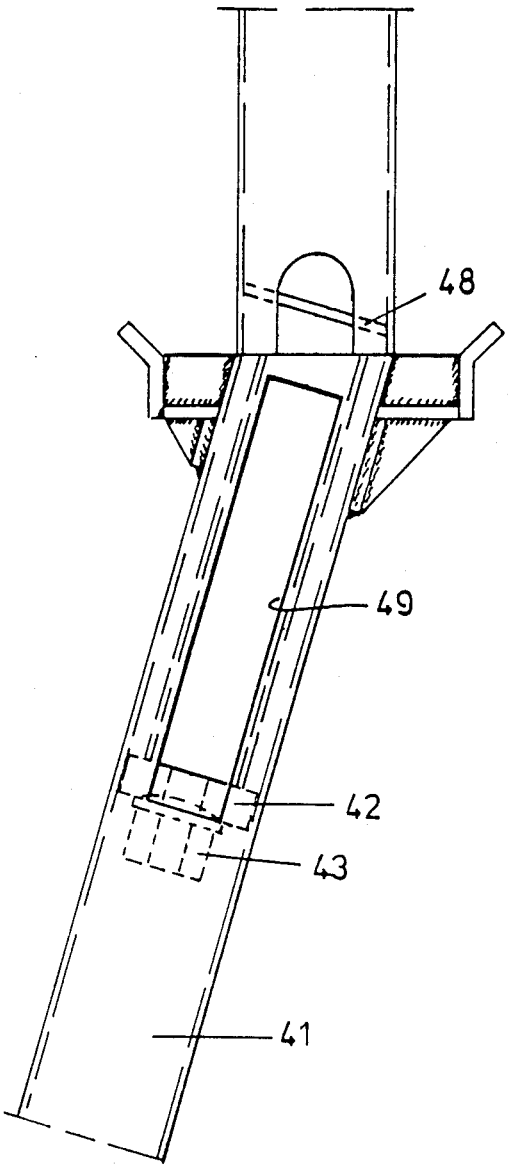
FIG. 6 illustrates a rigidly bent pile extension in the vicinity of the bearing support for the girder grillage and which can be used in the lower region of the pile according to FIG. 5.

FIG. 5 fragmentally shows a substantially linearly arranged pile 3 or 4, which in the lower region comprises the outer pile 40, into which a pile extension 41 is introduced from above. As is diagrammatically shown in FIG. 6, pile extension 41 can also be bent.

A transverse spindle plate with nut 43 fixed thereto can be provided in the pile extension 41 engaging in outer pile 40. In the case of a roughly square pile cross-sectional shape an elongated, rectangular recess 49 extends roughly from spindle plate 42 into the vicinity of the bearing support for the lower cords 15 of girder grillage 7 and in said recess is guided in vertically adjustable manner a bearing beam 50.

In the axial direction of outer pile 40 a drilled spindle 44 is provided on the inside and it is in rotary threaded engagement with nut 43. At the upper end, in the vicinity of the bearing for lower cord 15, said spindle 44 rests with a widened head on a thrust bearing 34 permitting a rotary movement. Thrust bearing 34 is downwardly supported against the bearing beam 50 articulated or fixed to the outer pile 40. Optionally following a bend of the pile extension and somewhat above the drilled spindle 44 a guide plate 48 is fixed within the pile spar. This guide plate 48 has a central opening, through which downwardly projects a sliding profile shaft and is in rotary engagement with the inner bore of spindle 44. Above guide plate 48 is provided a spider 45 by means of which the upwardly projecting top spindle 47 can exert a rotary movment on drilled spindle 44 and therefore bring about a vertical adjustability of the pile.

In the case of an extension of pile 40, e.g. by means of a clockwise rotation of top spindle 47, the lower end of the drilled spindle 44 would be turned downward by nut 43, so that pile extension 41 is drawn upwards out of the outer pile 40. Here again the lengthwise adjustable means is advantageously tensile stressed.

Figure 7:
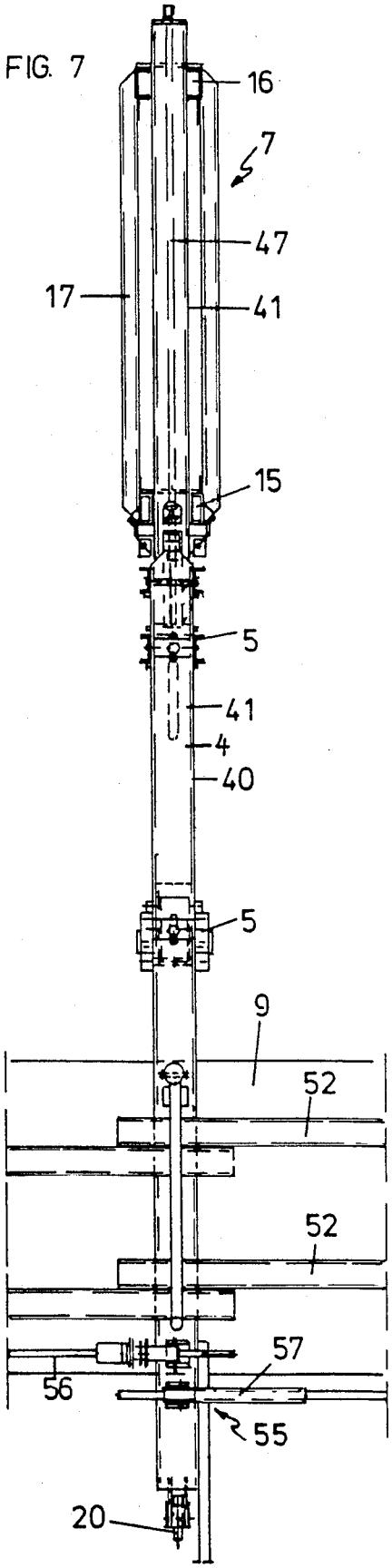
FIG. 7 illustrates a plan view in the radial direction of a pile with securing of the overlapping locking ring.
Figure 8:
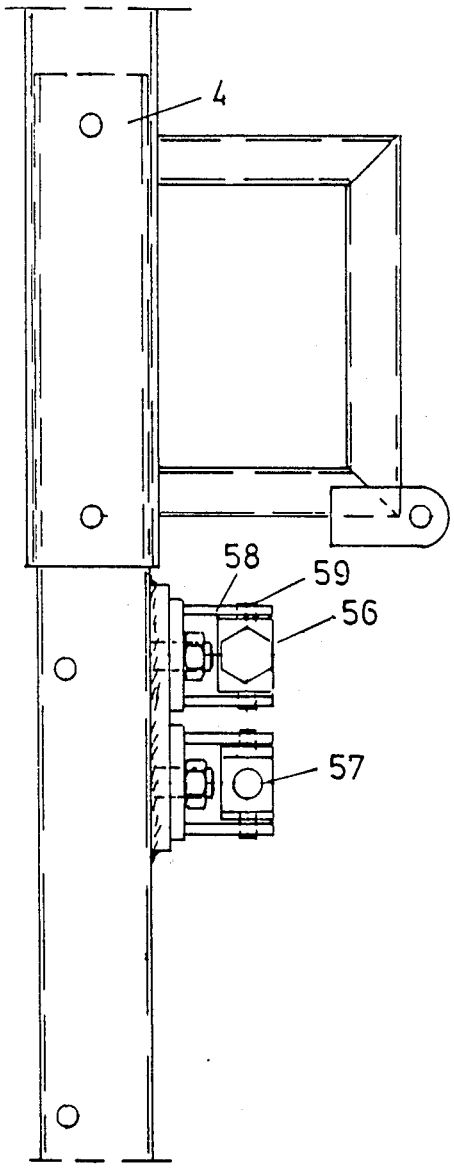
FIG. 8 illustrates a fragmental view of a pile in the circumferential direction in the vicinity of the locking ring.
Figure 9:
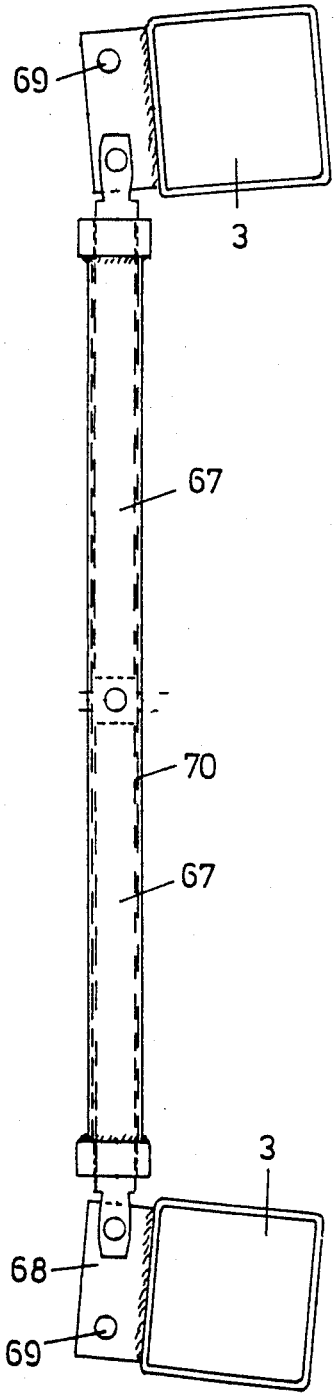
FIG. 9 illustrates a plan view of the arrangement of a locking ring between two inner piles.
Figure 10:
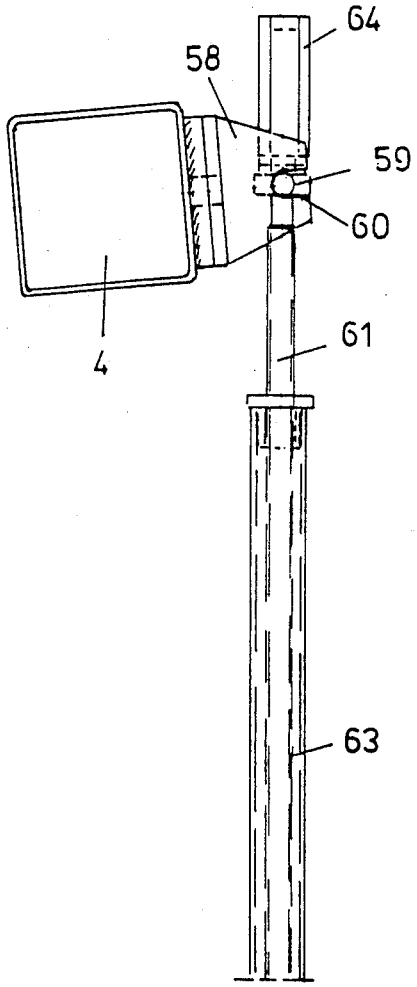
FIG. 10 illustrates a plan view of the outer locking ring between adjacent piles.

FIG. 7 is a diagrammatic representation of pile 40 in its arrangement in the sliding shuttering system with a radial plan view. The outer pile 4 has with respect to its extendability a lower pile 40 and upper pile extension 41. The actual sliding shuttering 9 is supported on lower pile 40, e.g. by means of circumferentially directed guide means or form pipe 52 overlapping in the pile region. On the wall-remote side of pile 4 in the lower region is provided a pull or thrust ring 55 with overlapping upper and lower circumferential spindles 56, 57 fixed to the pile. The bottom end of pile 4 is supported against the concrete wall by means of a sliding roller 20.

The girder grillage 7 produced as a lightweight construction is mounted by its lattice structure 17 via lower cord 15 on pile 4. Appropriately the pile extension 41 projects over the girder grillage 7, so that top spindle 47 can be operated from above the said grillage.

FIGS. 7 to 10 show the arrangement and basic constructional principle of the pull and thrust locking ring 55, which comprises circumferential spindles 56, 57 arranged between adjacent piles and connected in articulated manner to the pile by means of roughly vertical pins 59 and plates 58 projecting from the pile. The upper and lower circumferential spindles 57, 56 essentially comprise a threaded spindle 61 engaging in a pipe 63. The non-positive engagement with the pile by means of a plate can be brought about by means of a U-shaped recess 60 and a pin with nut 59 engaging therein. On the end region of spindle 61 can be provided a control device 64, e.g. a hydraulic motor or hexagon, by means of which spindle 61 can be turned in or out of the pipe.

The inner piles 3 are similarly circumferentially adjustable with respect to one another. The corresponding circumferential spindles do not overlap in this case and instead engage on a common plate 68 projecting from the pile on the wall-remote side. Between adjacent piles 3, the circumferential spindles have two opposing inner spindles 67 non-positively connected by an outer pipe 70 with an internal thread. The ends of the inner spindles 67 are articulated by means of a pin 69 to the corresponding pile. As a result of the oppositely directed threads of inner spindles 67, on rotating the outer pipe 70 the circumferential spacing between adjacent piles is increased or decreased.

Thus, in the case of an annular structure, the individual circumferential spindles form a closed pull and thrust locking ring 55, which is used for taking up horizontal forces, for reciprocal circumferential adjustment of the piles, and for fixing the circumferential distance between piles after adjustment.

We claim:

1. A sliding shuttering system for producing structure walls for conical and sloping reinforced concrete structures with annularly closed, varying cross-sections, comprising:

circumferentially spaced associated pairs of substantially parallel inner and outer elongate piles carrying radially spaced inner and outer sliding shuttering;

support means for supporting said piles and said sliding shuttering, said support means including an intrinsically rigid support truss fixable above the top of a wall of a structure and arranged substantially horizontally;

a lengthwise adjustable means connecting said inner and outer piles and said inner and outer sliding shuttering to said rigid support truss, said lengthwise adjustable means adjusting angular deflection of said inner and outer piles over their lengths in a tangential direction and comprising a universal joint to accommodate the angular deflection of said inner and outer piles;

a pile cross member extending between the inner pile and the outer pile of each said associated pair above said shuttering thereby forming a pile structure;

said pile cross members being articulatable relative to and adjustably connected to at least one pile in a transverse direction relative to said wall for adjustably maintaining the spacing between the inner and the outer piles;

a lifting means for sliding said sliding shuttering system up relative to the ground, said lifting means engaging with said pile structure;

a fixing means provided to fix at least some of said inner and outer piles which are spaced over the circumference of the structure wall relative to said support truss for preventing horizontal shifting of said piles.

2. A sliding shuttering system according to claim 1, and further comprising:

adjustable locking ring means respectively connecting said outer piles to each other and said inner piles to each other, said locking ring means permitting reciprocal circumferential adjustment of the outer piles and inner piles and fixing the circumferential distance between piles, after adjustment; and a slide supporting means on lower ends of said inner and outer piles in the vicinity of the structure wall to slidingly support said inner and outer piles against previously formed sections of the structure wall.

3. A sliding shuttering system according to claim 1, wherein said rigid support truss is constructed as a girder grillage forming a lattice with radially extending, circumferentially spaced lower and upper girder pairs, and wherein said inner and outer piles comprise circumferentially spaced top pile extensions guided between said girder pairs.

4. A sliding shuttering system according to claim 1, wherein a locking means is coupled horizontally between said inner piles and between said outer piles to permit reciprocal circumferential adjustment of the outer piles and inner piles and fix the circumferential distance between piles after adjustment.

5. A sliding shuttering system according to claim 1, wherein said lengthwise adjustable means comprises a telescopic means provided internally in said piles for adjusting the lengths of said piles.

6. A sliding shuttering system according to claim 1, and further comprising:

an articulation and expansion means for said rigid support truss provided on said piles in a bearing region; and an oppositely repeating articulation and expansion means provided in a vertical region of said support truss.

7. A sliding shuttering system according to claim 1, wherein said lengthwise adjustable means is tensile stressed when it adjusts the angular deflection of said inner and outer piles over their lengths.

8. A sliding shuttering system according to claim 1, wherein said lengthwise adjustable means comprises a telescopic means provided externally on said piles for adjusting the lengths of said piles.

* * * * *